US006050156A

United States Patent [19]

Buck

[11] Patent Number: 6,050,156

[45] Date of Patent: Apr. 18, 2000

[54] BRAKING MECHANISM FOR POWER TONGS

[76] Inventor: David A. Buck, 1348 Sawmill Highway, Breaux Bridge, La. 70517

[21] Appl. No.: 08/897,185

[22] Filed: Jul. 21, 1997

Related U.S. Application Data

[63] Continuation-in-part of application No. 08/757,017, Nov. 26, 1996.

[51] Int. Cl.[7] ..... B25B 17/00

[52] U.S. Cl. ..... 81/57.15; 81/57.33

[58] Field of Search ..... 81/57.11, 57.15, 81/57.33, 57.42, 57.43, 57.44, 58.2, 57.16, 57.34

[56] References Cited

U.S. PATENT DOCUMENTS

| | | | |
|---|---|---|---|
| 4,084,453 | 4/1978 | Eckel | 81/57.18 |
| 4,291,598 | 9/1981 | Cherry | 81/57.15 |
| 4,401,000 | 8/1983 | Kinzbach | 81/57.15 |

*Primary Examiner*—James G. Smith
*Assistant Examiner*—Benjamin M. Halpern
*Attorney, Agent, or Firm*—Roy, Kiesel & Tucker

[57] ABSTRACT

The present invention relates to power tongs used in the oil and gas industry to make up and break apart the joints on drill pipe and other tubular members. The invention provides a selectively releasable braking apparatus for a power tong. The selectively releasable braking apparatus comprises a braking ring operatively connected to a cage plate of the power tong and a braking surface mechanically connected to the cage plate. The apparatus further has a gripping device capable of selectively gripping and holding the braking surface and has a gear train transferring torque from said brake ring to said braking surface. Power tongs also typically have a throat, a ring gear with an opening, and a cage plate with an opening. The present invention further provides an apparatus for aligning the openings in the ring gear and the cage plate with the throat of the power tong and remotely reversing the direction of rotation of the ring gear and cage plate. The apparatus comprises a stop device preventing relative rotation of the ring gear and the cage plate until a preselected torque load is placed on said stop device. The apparatus also has a selectively releasable cage plate brake and a cage plate latch selectively preventing rotation of the cage plate.

19 Claims, 13 Drawing Sheets

BRAKING MECHANISM FOR POWER TONGS

This is a continuation-in-part of copending application Ser. No. 08/757,017 filed on Nov. 26, 1996, which is hereby incorporated by reference into this application.

FIELD OF THE INVENTION

The present invention relates to power tongs typically used in the oil and gas industry to make up and break apart threaded joints on pipe, casing and similar tubular members. In particular, the present invention deals with an improvement to the braking mechanism found on most power tongs. The present invention also deals with a mechanism allowing a power tong operator to reverse, from a remote location, the direction in which the power tong is rotating the tubular members.

BACKGROUND OF THE INVENTION

Power tongs have been in existence for many years and are generally employed in the oil and gas industry to grip and rotate tubular members, such as drill pipe. It is necessary to grip drill pipe with high compressive forces while applying a high degree of torque in order to break apart or tighten threaded pipe connections. An example of a conventional power tong can be seen in U.S. Pat. No. 4,084,453 to Eckel. Most current power tong designs such as Eckel include an open slot or throat, through which the drill pipe is passed in order to place the power tong in position around the pipe. Typically power tong designs employ a cam mechanism for converting a portion of the torque into a gripping (compressive) force normal to the pipe. This conversion is often accomplished utilizing a power-driven ring gear having an interior cam surface. The ring gear will also have an opening corresponding in size to the throat of the power tong. The ring gear is rotatively positioned between an upper and a lower cage plate which form a jaw carrier. The cage plates are also rotatively positioned in the power tongs and also have openings corresponding with the throat of the power tong. Multiple jaw members are typically secured between the upper and lower cage plates in such a manner that relative movement between the ring gear and cage plates causes the jaws to ride upon the cam surfaces and to close on the drill pipe. After the jaws have closed on the drill pipe, the cage plates and the ring gear will then rotate as a unit to apply torque to the drill pipe.

In order to initially hold the cages plates stationary while the ring gear rotates sufficiently to close the jaws, a brake band typically encircles the upper cage plate. The brake band applies an initial frictional force to the cage plate, holding the cage plates stationary and allowing the ring gear to move relative to the cage plates. Generally, the brake band is adjustable such that it may be tightened or loosened in order to vary the amount of frictional force applied to the cage plate. After relative rotation begins and the jaws mount the cam surfaces and close on the drill pipe, the jaws will begin to transfer torque to the cage plates which will eventually overcome the resisting frictional force of the brake band. Because the cam surfaces translate torque into radial force, a higher torque needed to overcome the resistance of the brake band will result in a higher radial force being placed on the drill pipe. Therefore the frictional resistance of the brake band may be adjusted to regulate the radial load placed on the drill pipe.

While the prior art brake band has accomplished its intended function, it is very inefficient. After the cage plates and ring gear begin moving as a unit to rotate the drill pipe, the friction caused by the brake band now provides undesirable resistance to the torque being applied to the drill pipe and the energy expended by the power tongs in overcoming this resistance is wasted. Also, since it is primarily the resistance of the brake band which determines the radial force with which the jaws grip the drill pipe, this force cannot be varied without stopping work to adjust the brake band. Furthermore, it is difficult to insure the brake band will provide a constant resisting force to the cage plate. For example, grease or a similar substance may be deposited between the cage plate and brake band thereby lowering the frictional resistance of the brake band. Additionally, brake bands wear over time and do not grip as tightly as originally designed. This wearing tendency is often caused by the fact that the cage plate does not present a continuous surface but has an opening corresponding to the throat of the power tong. The contact of this opening with the brake band during rotation of the cage plate causes excessive wear and damage to the brake band.

After the desired torque has been applied to a drill pipe joint, the direction of the ring gear's rotation is reversed to allow the jaws to back off of the cam surfaces and release the pipe. Again the brake band holds the cage plate stationary during the ring gear's initial reverse rotation. Once the jaws have backed off the cam surfaces, it is necessary for the ring gear and cage plates to move in unison to align the openings of the cage plates and the ring gear with the throat of the power tongs. This is accomplished by the interaction of a backing lug on the ring gear and a backing pin inserted into the upper cage plate. The upper cage plate will have two apertures for receiving the backing pin. The backing pin is inserted into one of the two apertures depending on which direction the ring gear will be applying torque to the drill pipe. The ring gear will rotate relative to the cage plates until the backing pin contacts the backing lug. At this point, the openings of the ring gear and cage plates will be aligned and the interaction of the backing pin and backing lug will cause the ring gear and cage plates to rotate together. The operator of the power tong continues to rotate the ring gear in order to observe when the openings of the ring gear and cage plates are aligned with the throat of the power tongs. This alignment is necessary to back the power tongs off of the drill pipe.

This leads to another disadvantage encountered in prior art power tongs when the tong operator desires to reverse the rotational direction of the power tong. To do so, the operator must manually switch the backing pin to the alternate aperture. This may be very difficult in certain drilling operation, such as when operations are being carried out by an automated pipe handling system and the operator controlling the power tong is working from a control station some distance from the tong. The remote controlling of power tongs presents another problem in that the operator may not be able to view the throat of the power tong from his location. Thus the operator is not able to visually align the openings of the ring gear and cage plates with the power tong's throat in order to back the power tong off of a drill pipe.

SUMMARY OF THE INVENTION

Therefore it is an object of this invention to provide a selectively releasable braking apparatus for use in conjunction with a power tong.

It is another object of this invention to provide a braking apparatus allowing a selective radial load to be placed on the drill pipe or other tubular member.

It is still another object of this invention to provide an apparatus which allows the direction of rotation of the power tong to be reversed from a remote location without the manual operation of a backing pin.

It is a further object of this invention to provide an apparatus which will automatically align the throat of the power tong and the openings in the ring gear and the cage plates without the operator needing to view the power tong throat.

Accordingly, a selectively releasable braking apparatus for a power tong is provided. The selectively releasable braking apparatus comprises a braking ring operatively connected to a cage plate of the power tong and a braking surface mechanically connected to the cage plate. The apparatus further has a gripping device capable of selectively gripping and holding the braking surface and has a gear train transferring torque from said brake ring to said braking surface.

Furthermore, in a power tong having a throat, a ring gear with an opening, and a cage plate with an opening, the present invention provides an apparatus for aligning the openings in the ring gear and the cage plate with the throat of the power tong and remotely reversing the direction of rotation of the ring gear and cage plate. The apparatus comprises a stop device preventing relative rotation of the ring gear and the cage plate until a preselected torque load is placed on said stop device. The apparatus also has a selectively releasable cage plate brake and a cage plate latch selectively preventing rotation of the cage plate.

DETAILED DESCRIPTION OF PREFERRED EMBODIMENTS OF THE INVENTION

Figure 1:
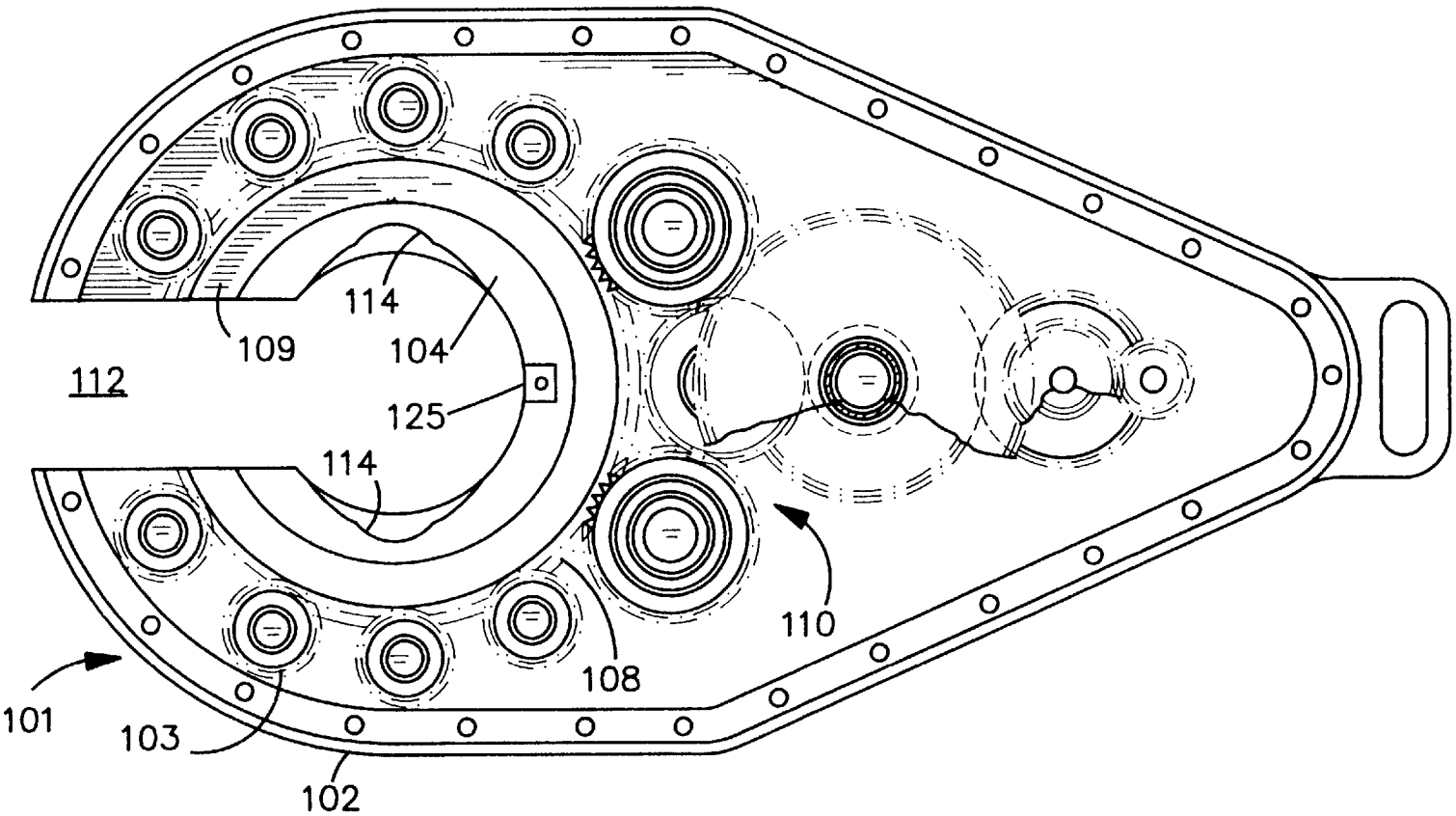
PRIOR ART FIGURE 1
FIG. 1 is a top view of a prior art power tong with the upper cage plate removed.
Figure 2:
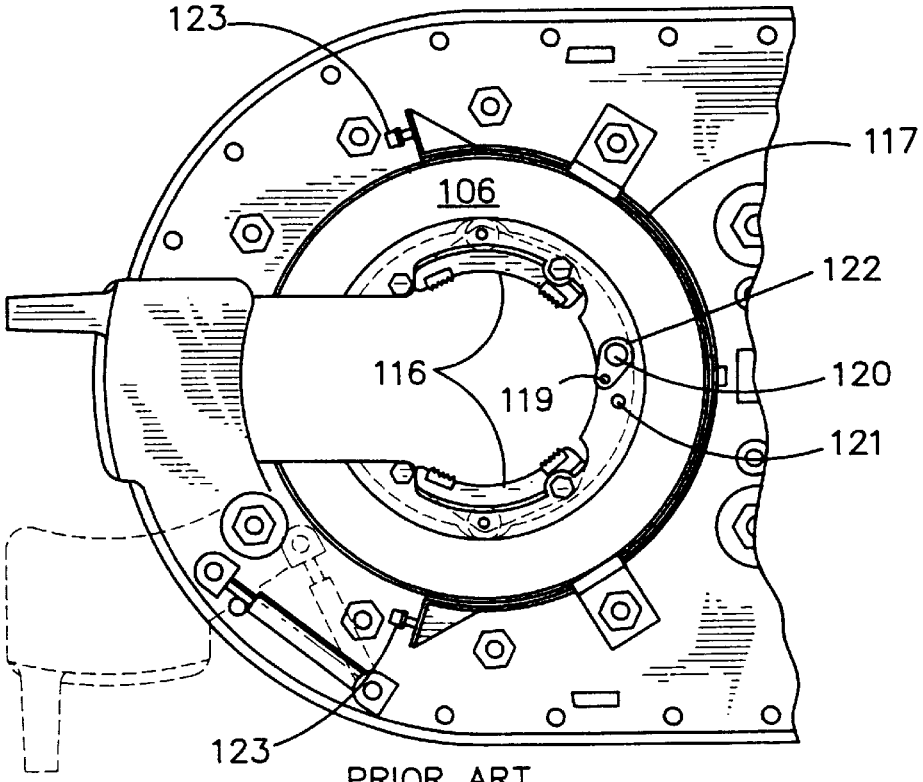
PRIOR ART FIGURE 2
FIG. 2 is a top view of a prior art power tong showing the brake band and reversing pin.
Figure 3:
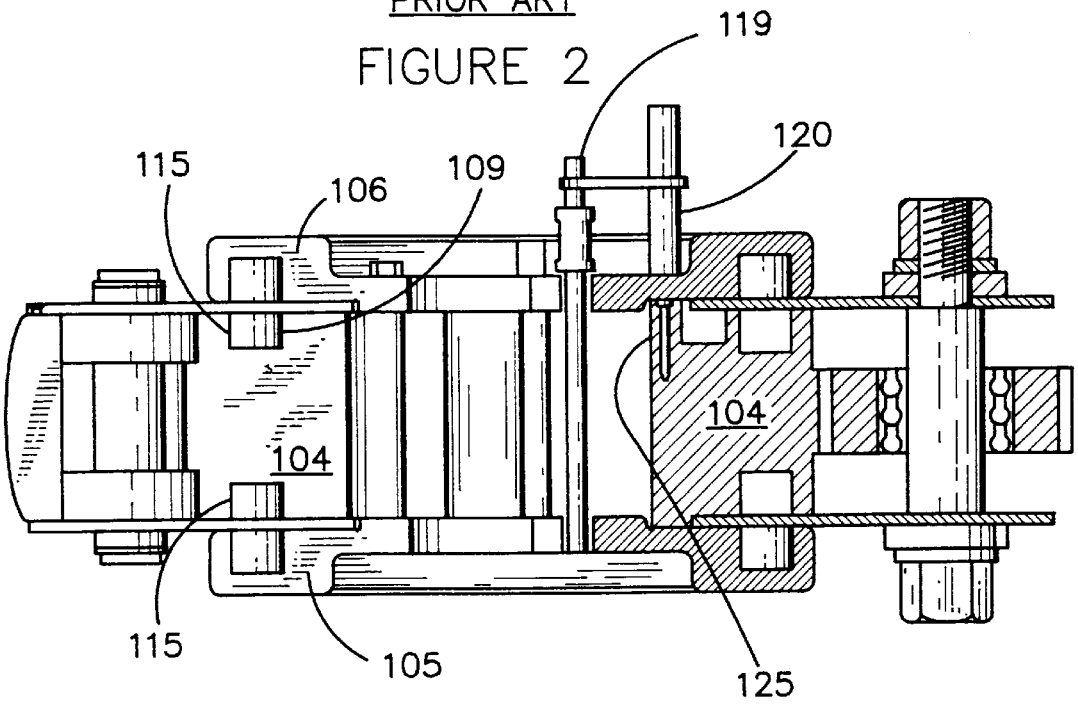
PRIOR ART FIGURE 3
FIG. 3 is a cross-sectional view of a prior art power tong illustrating the cage plates' positioning with respect to the ring gear.

FIGS. 1–3 illustrate a prior art power tong 101. FIG. 1 illustrates power tong 101 is of the type having an open throat 112. FIG. 1 shows power tong 101 with the cover plate and top cage plate removed in order to show the main internal components positioned within frame 102 of power tong 101. Frame 102 contains a series of rollers 103 running along the inner periphery of the front end of frame 102. Ring gear 104 is positioned between and supported by rollers 103 such that ring gear 104 may rotate within frame 102. Both the cage plates 106 and 105 (seen in FIG. 3) and ring gear 104 have openings which correspond in size to throat 112. The outer periphery of ring gear 104 will have a series of gear teeth 108 (shown schematically) positioned thereon. Gear teeth 108 will engage the cogs of drive train 110 in order to impart torque to ring gear 104. The inner periphery of ring gear 104 will also have a plurality of cam surfaces 114 formed thereon which will operate to open and close jaws 116 (seen in FIG. 2). Still viewing FIG. 1, ring gear 104 will further have channel 109 formed on its upper and lower surfaces. Channel 109 is sized to engage roller bearings 115 (seen in FIG. 3) which are connected to the cages plates 106 and 105. It will be understood that when ring gear 104 is assembled in power tong 101 between upper and lower cage plates 106 and 105, ring gear 104 is able to rotate relative to cage plates 106 and 105 on roller bearings 115. In order to hold the cage plates stationary while ring gear 104 rotates, a brake band 117 (seen in FIG. 2) will surround a portion of the periphery of upper cage plate 106 and impart a frictional resistance to upper cage plate 106. The amount of frictional resistance imparted may be adjusted by tightening screws 123 on brake band 117. However, the degree to which ring gear 104 is able to rotate relative to cage plates 106 and 105 is limited. After jaws 116 have mounted cam surfaces 114 and gripped the tubular member, jaws 116 become increasingly tightly engaged between the tubular member and ring gear 104 as the jaws travel up the cam surfaces 114. At this point the force needed to move jaws 116 further up cam surfaces 114 is greater than the force needed to overcome the frictional resistance of brake band 117. Further rotation of ring gear 104 will cause jaws 116 to impart sufficient torque to cages plates 106 and 105 to overcome the frictional resistance of brake band 117. Thereafter, ring gear 104 and cage plates 106 and 105 rotate together to apply torque to the tubular member.

In order to align the openings in cage plates 106 and 105 and ring gear 104 with the power tong throat 112, the power tong employs the backing lug 125 seen in FIG. 1. Backing lug 125 is positioned on ring gear 104 and will engage backing pin 120 as seen in FIG. 3. As best seen in FIG. 2, backing pin 120 will be positionable in either one of backing pin apertures 121 or 122. Backing pin apertures 121 and 122 are positioned on either side of backing lug 125 when the openings of ring gear 104 and cages plates 106 and 105 are aligned. Retaining bolt 119 will allow backing pin 120 enough movement to be switched from pin aperture 121 to 122 while insuring backing pin 120 cannot be completely separated from cage plate 106. As discussed above, while generally carrying out its intended function, this prior art power tong has numerous disadvantages.

Figure 4:
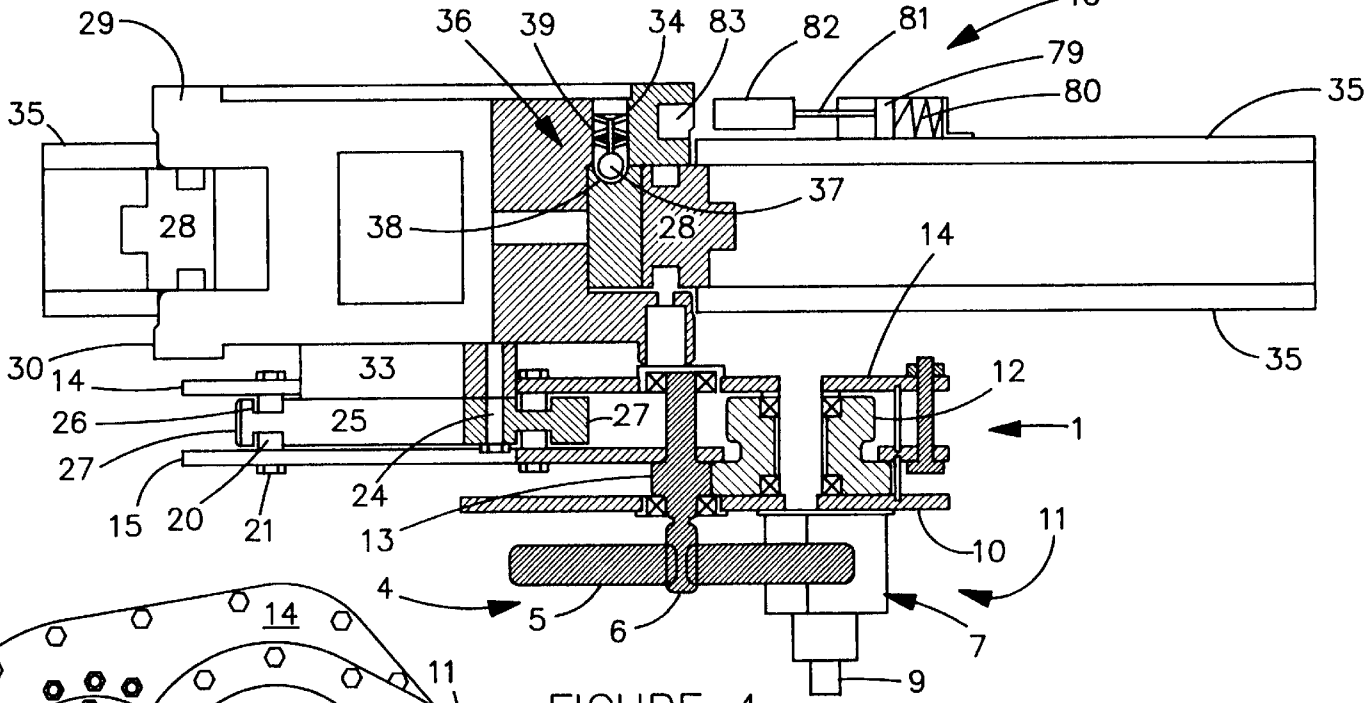
FIG. 4 is a cross-sectional view of the present invention attached to a conventional power tong body.
Figure 5:
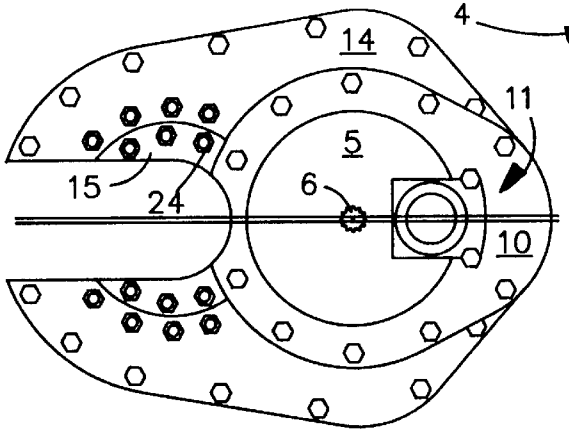
FIG. 5 is a plane view of the present invention.
Figures 6, 7:
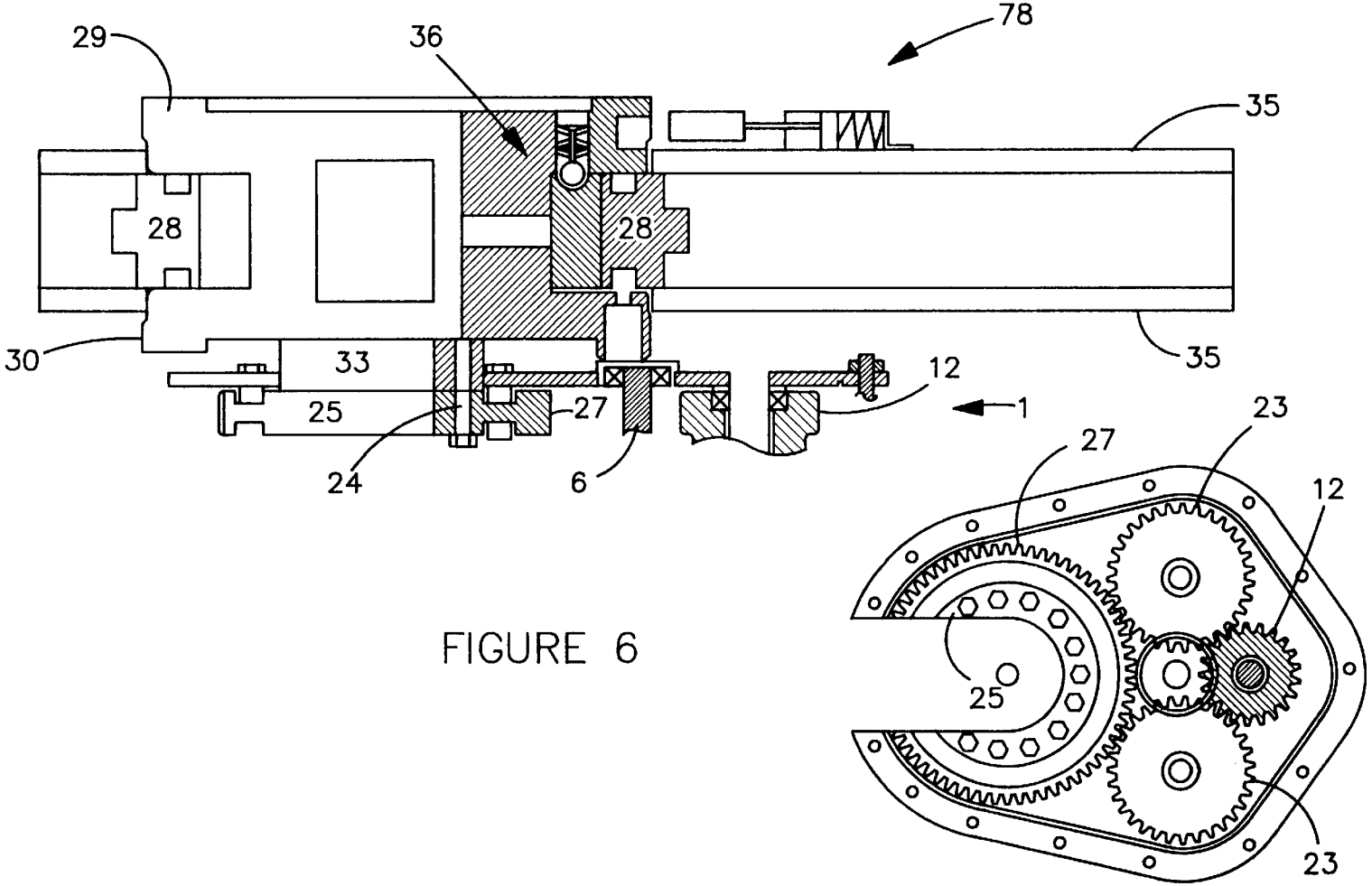
FIG. 6 is a cross-sectional view of the present invention with the cover plates removed.
FIG. 7 is a plane view of the present invention with the cover plates removed illustrating the secondary braking gears.

It is an object of the present invention to provide a selectively releasable braking apparatus which eliminates many of the disadvantages of the prior art brake band. Turning to FIG. 4, the braking apparatus 1 is illustrated as mounted on the lower cage plate 30 of a conventional power tong. For simplicity, the only parts of the conventional power tong shown are upper cage plate 29, lower cage plate 30, ring gear 28 and the rear portion of power tong body plates 35. The braking apparatus 1 will have a brake ring 25 which is positioned between an upper brake ring plate 14 and a lower brake ring plate 15. A spacer or adapter 33 will be positioned between cage plate 30 and upper brake ring plate 14. As seen in FIG. 5, brake ring 25 and spacer 33 will have openings corresponding to the openings in cage plates 106 and 105 and in ring gear 104, all of which correspond to the throat 112 of power tong 101 such that a tubular member may be position inside power tong 101. Roller bearings 20 will be attached to brake ring plates 14 and 15 by bolts 21. Roller bearings 20 will ride in groove 26 such that brake ring 25 is rotatively mounted between brake ring plates 14 and 15. A series of bolts 24 will connect brake ring 25 to bottom cage plate 30 such that these components must rotate together. Brake ring 25 will have gear teeth 27 which will engage secondary braking gears 23 as best seen in FIG. 7. The secondary braking gears 23 will in turn engage primary braking gear 12. Returning to FIG. 4, primary braking gear 12 will engage teeth 13 of brake disc stem 6 such that torque may be transferred from braking gear 12 to a braking surface 4, which in the embodiment shown is brake disc 5. It will be understood that this gear train arrangement allows torque imparted to cage plate 30 to be transferred to brake disc 5. It will also be understood that the term "gear train" is not limited to a particular number or configuration of gears. Further, any number of alternative gear trains could be used as long as these gear trains were capable of transferring torque from cage plate 30 to a braking surface 4 such as brake disc 5. As best seen in FIG. 4, primary braking gear 12 and brake disc stem 6 will be contained between plates 14 and 10.

Figure 10:
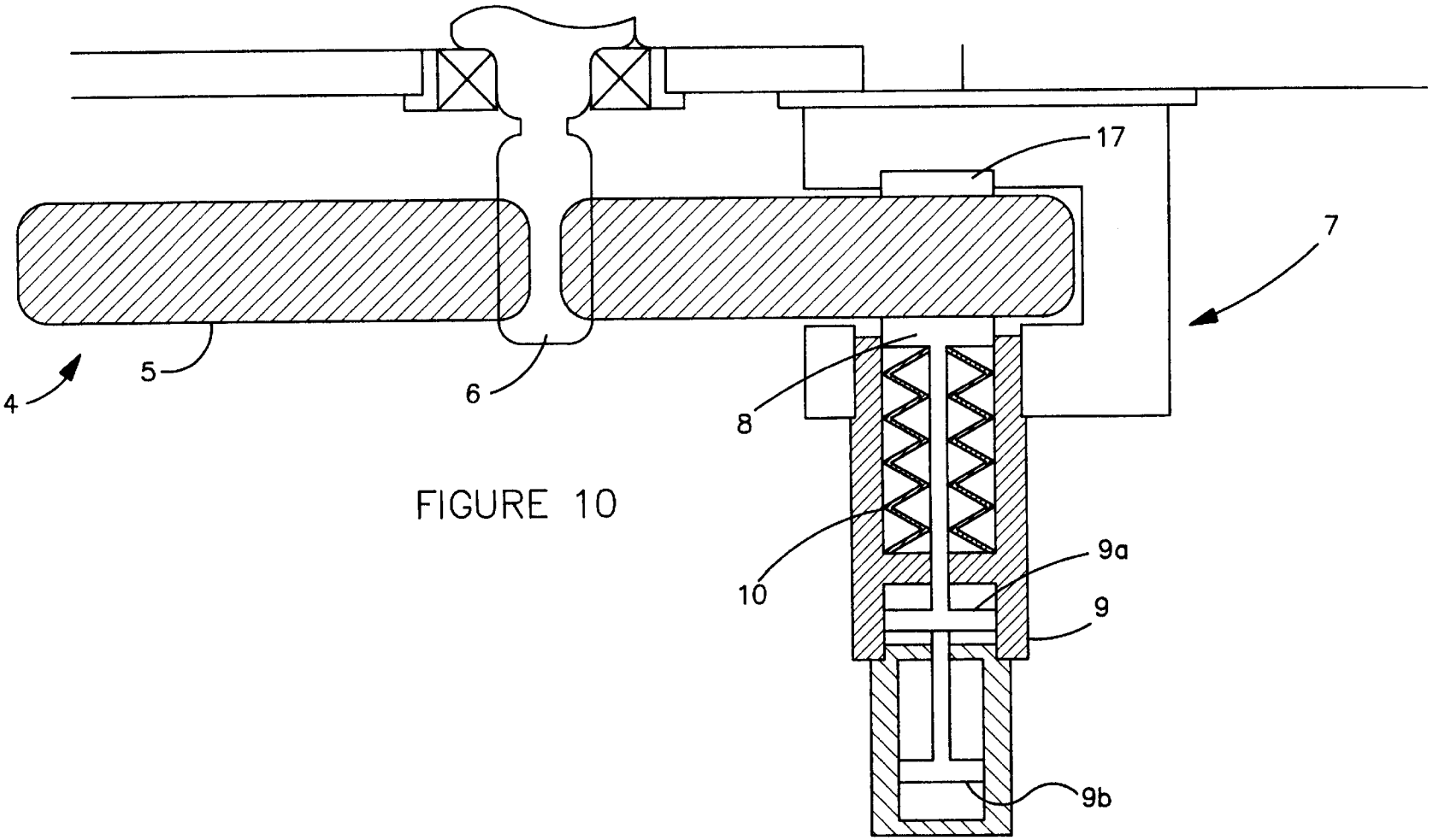
FIG. 10 is a detailed view of a preferred braking surface gripping device of the present invention.

To grip the braking surface 4, apparatus 1 has a gripping device 11 which is capable of gripping and holding the braking surface 4. In the embodiment shown in FIG. 4, this gripping device 11 is a selective gripping device comprising brake caliper 7 having an internal caliper finger to grip brake disc 5. FIG. 10 illustrates how caliper finger 8 of brake caliper 7 will press against brake disc 5 in order to exert a gripping force by seizing brake disc 5 between caliper finger 8 and brake pad 17. Caliper finger 8 and brake pad 17 will be constructed of any conventional material which is wear resistant but also has a high coefficient of friction. Brake caliper 8 will be biased in the closed position such that finger 8 and pad 17 will grip brake disc 5 until a counter-acting force causes caliper finger 8 to release brake disc 5. In the embodiment of FIG. 10, the biasing force will be provided by spring 18 and the counter-acting force will be provided by the piston of dual piston cylinder 9 positioned on brake caliper 7. It can be seen that spring 18 biases the piston of dual piston cylinder 9 in the closed position (i.e. gripping the baking surface 4). Dual piston cylinder 9 will also include a smaller piston head **9*b* and a larger piston head 9*a*. Larger piston head 9*a* allows spring 18 to be overcome and braking surface 4 to be released by a lower pressure source than required by smaller piston head 9*b*. While not shown, hydraulic fluid lines or other conventional means will provide the activating force to dual piston cylinders 9. The function of this low pressure/high pressure release mechanism will be explained in greater detail below. However, the present invention is intended to include within its scope any alternate release mechanism. The release mechanisms could include single piston devices activated at one pressure level or non-hydraulic devices that release the gripping device 11's hold on braking surface 4**.

Figures 8, 9:
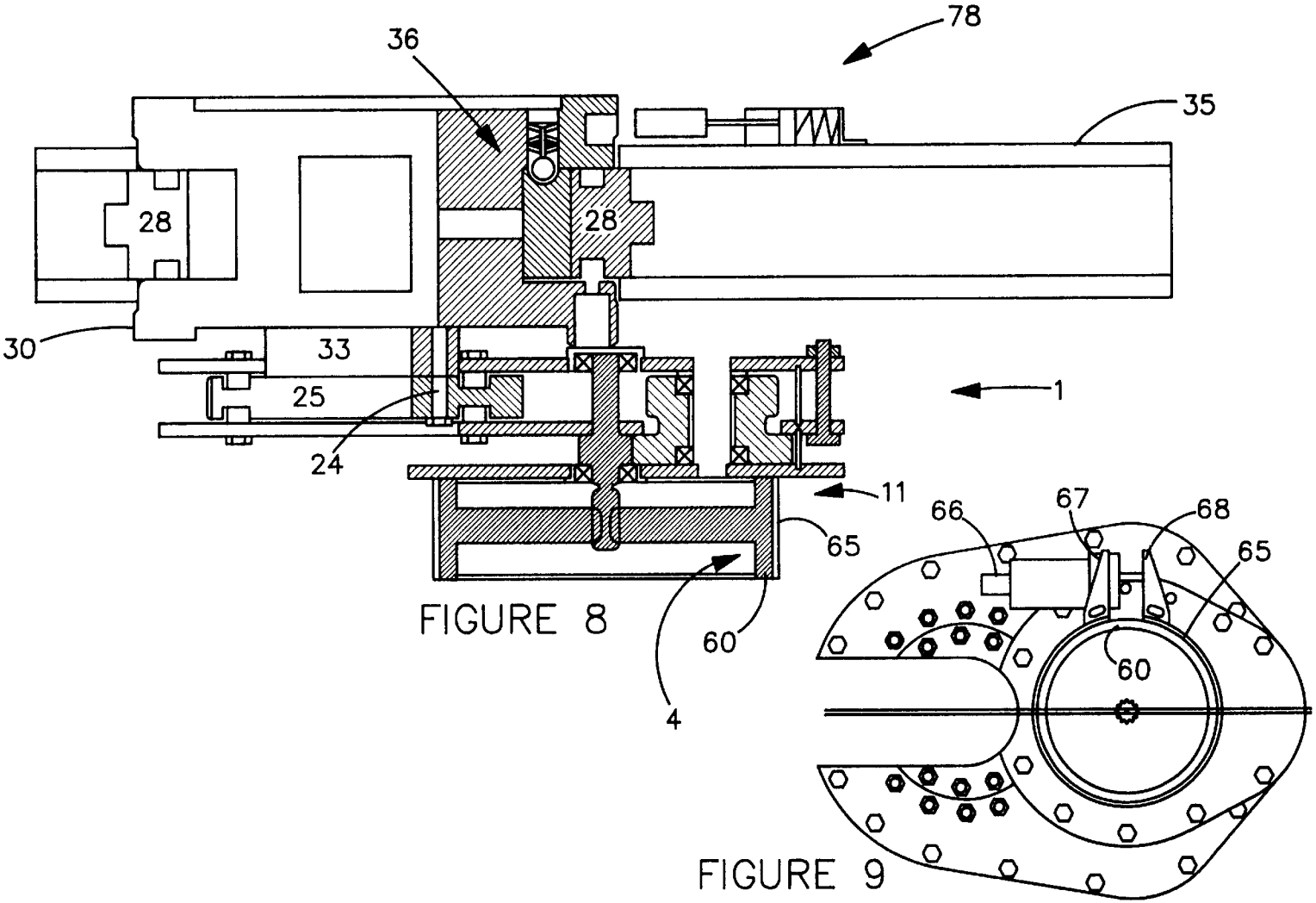
FIG. 8 is a cross-sectional view of an alternate embodiment of the present invention.
FIG. 9 is a plane view of the alternate embodiment illustrating the device for selectively operating the brake band.

An alternate embodiment of the braking apparatus 1 is seen in FIGS. 8 and 9. FIG. 8 illustrates a braking surface 4 comprising a brake drum 60 operatively connected to the gear train of the braking apparatus 1. The gripping device 11 engaging brake drum 60 will be formed by, a selective brake band 65 positioned about the perimeter of brake drum 60. Brake band 65 will not entirely encompass the circumference of brake drum 60, but will leave a slight gap between its terminal ends as best seen in FIG. 9. Each end will have end projection 67 or 68 extending therefrom. Similar to the caliper fingers 8 described above, end projections 67 and 68 will be biased together by a spring or similar device in a brake band releasing piston assembly 66. While not shown, releasing piston assembly 66 will be constructed similarly to gripping device 11 seen in FIG. 10. A spring in releasing piston assembly 66 will bias end projections 67 and 68 together, constricting brake band 65 which then grasps brake drum 60 and prevent its rotation. In order to expand selective brake band 65, hydraulic fluid will be supplied to releasing piston assembly 66 and internal pistons will then overcome the spring biasing end projections 67 and 68 together. In the embodiment shown, constricting piston assembly 66 also has a dual piston cylinder similar to that explained in reference to brake caliper 7. Releasing piston assembly 66 may receive hydraulic fluid from any conventional hydraulic circuit or the novel hydraulic circuit described below.

The scope of the present invention is intended to include any mechanism for selectively constricting brake band 65 or causing gripping device 11 to grip brake disc 5. Such a mechanism could include a threaded or screw device which may be electrically or hydraulically operated in order to allow control from a remote location. Alternatively, a conventional threaded or screw device that is manually tightened or loosened could be employed. While a braking apparatus 1 using a manually operated tightening device on brake band 65 or gripping device 11 could not be remotely controlled, such a braking apparatus 1 would still have significant advantages over the prior art. The brake band would not wear and loosen as in the prior art and grease or other substances on cage plate 30 would not cause slippage of braking apparatus 1.

Figure 12:
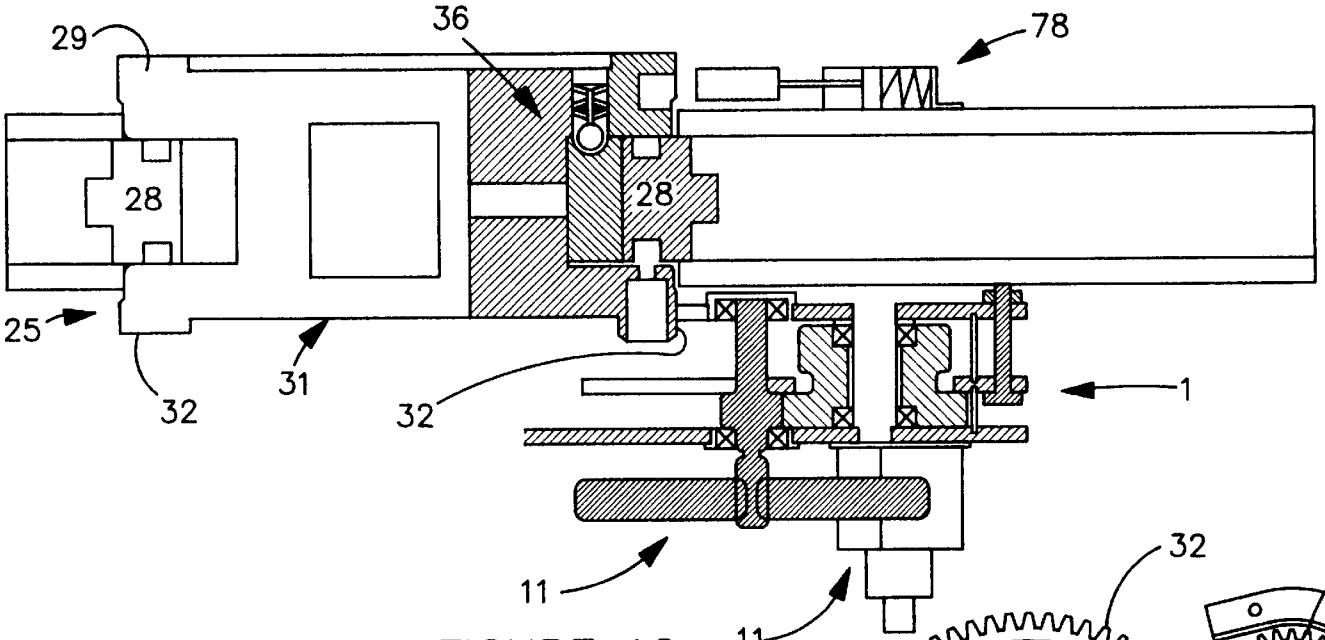
FIG. 12 is an alternate embodiment of the present invention illustrating the braking ring integrally formed on the cage plate.
Figure 13:
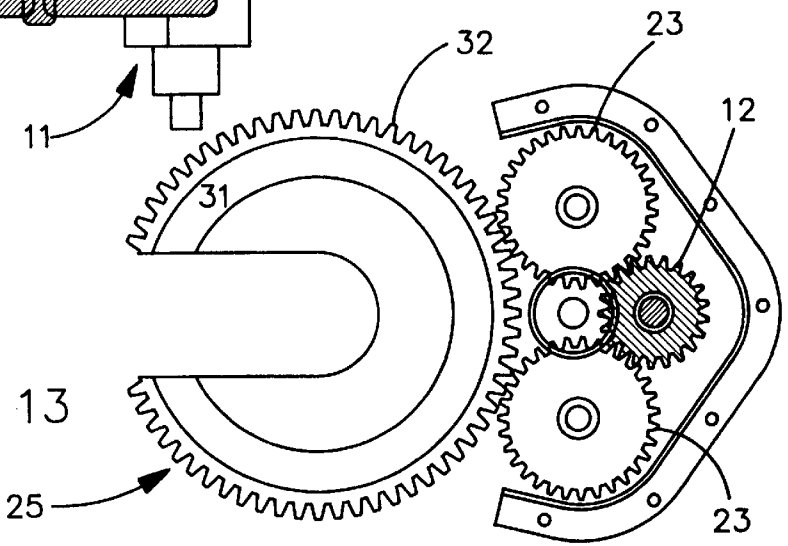
FIG. 13 is a plane view of the alternate embodiment showing the secondary braking gears.

The embodiments described above employ a separate braking ring which is bolted or otherwise attached to the cage plate of a conventional power tong. Another embodiment of the present invention is shown in FIGS. 12 and 13 and illustrates another manner in which the braking ring may be operatively connected to the cage plate of a power tong. This embodiment comprises a novel cage plate 31 with the braking ring 25 formed directly thereon. The gear teeth 32 of cage plate 31 will engage the secondary gears 23 of the gear train and thereby transfer torque to the braking surface 11 as described in the above embodiments. Cage plate 31 eliminates the need for a separate braking ring, adapter, and braking ring plates. The remaining components of braking apparatus 1 are the same for this embodiment as for those described above.

In operation, the power tong will be positioned such that the tubular member is in the throat of the power tong. To allow the jaws to grip the tubular member, it is necessary to rotate the ring gear 28 while holding the cage plates 29 and 30 stationary. The braking apparatus accomplishes this function by braking disc 5 preventing rotation of cage plates 29 and 30 while the drive train of the power tong rotates ring gear 28. After ring gear 28 has rotated sufficiently relative to cage plates 29 and 30 to close the tong jaws, further increases in torque will begin to increase the radial force the jaws are exerting on the tubular member. By controlling how much torque is applied to the ring gear 28 before the braking apparatus 1 releases cage plates 29 and 30, the present invention may control the amount of radial force placed on the tubular member by the jaws. This ability to control the radial force on the tubular member is of particular importance when the power tong is working stainless steel or Corrosion Resistant Alloy (CRA) tubular members. Contrary to the conventional toothed jaw members used to grip regular carbon steel tubular members, the face of jaw members gripping CRA tubular members must be comparatively smooth in order not to damage the costly CRA tubular member. Therefore the power tong must apply higher radial loads to the CRA tubular members to prevent slippage between the smooth jaw surfaces and the tubular member. The selective braking apparatus of the present invention allows the cage plate to be held as long as needed to apply the appropriate radial force to the tubular member. As a further advantage, the release of brake disc 5 after the appropriate radial force has been obtained eliminates practically ail frictional resistance caused by a braking mechanism and all power may be used to apply torque to the tubular member.

As discussed above, it is another object of this invention to provide an apparatus which will automatically align the throat of the power tong and the openings in the ring gear and the cage plates without the operator needing to view the power tong throat. As seen in FIG. 4, this apparatus will include a stop device which in FIG. 4 is detent means 36 for selectively locking the cage plates 29 and 30 and ring gear 28 together; and the apparatus will also include a selectively engagable cage plate latch 40 which selectively prevents the cage plates 29 and 30 from rotating relative to the long body. The apparatus will also incorporate the braking apparatus 1 described above.

Detent means 36 includes a ball 37 mounted in a bore 34 formed in ring gear 28. Ball 37 is biased downward by a spring 39 such that ball 37 will engage seat 38 when bore 34 and seat 38 are aligned. The embodiment shown will have a single detent means 36 which when engaged, will align the openings in cage plates 29 and 30 and ring gear 28. While only one detent means 36 is shown in the Figures, it will be understood that multiple detent means 36 could also be employed in alternate embodiments. The detent means 36 resists relative torque between cage plates 29 and 30 and ring gear 28 and causes these members to rotate together until a threshold torque overcomes spring 39 of detent means 36 and forces ball 37 into bore 34. Thereafter, cage plates 29 and 30 and ring gear 28 will be free to rotate relative to one another until detent means 36 is again engaged on the realignment of the openings of cage plates 29 and 30 and ring gear 28.

A cage plate latch 40 is also fixedly positioned on the power tong body and will selectively engage cage plate 29. Cage plate latch 40 will comprise a cylinder 79 having a piston 81 and a spring 80. Attached to piston 81 is a latch pin 82 which is biased toward a latch slot 83 formed on cage plate 29. When latch pin 82 engages latch slot 83, cage plate 29 will be prevented from rotating. To release cage plate latch 40, hydraulic fluid will be pumped into cylinder 79, forcing piston 81 rearward and disengaging latch pin 82 from latch slot 83. As long as fluid pressure is being supplied to cylinder 79, spring 80 will not return latch pin 82 to latch slot 83 and cage plate latch 40 does not inhibit rotation of cage plates 29 and 30.

Figure 11:
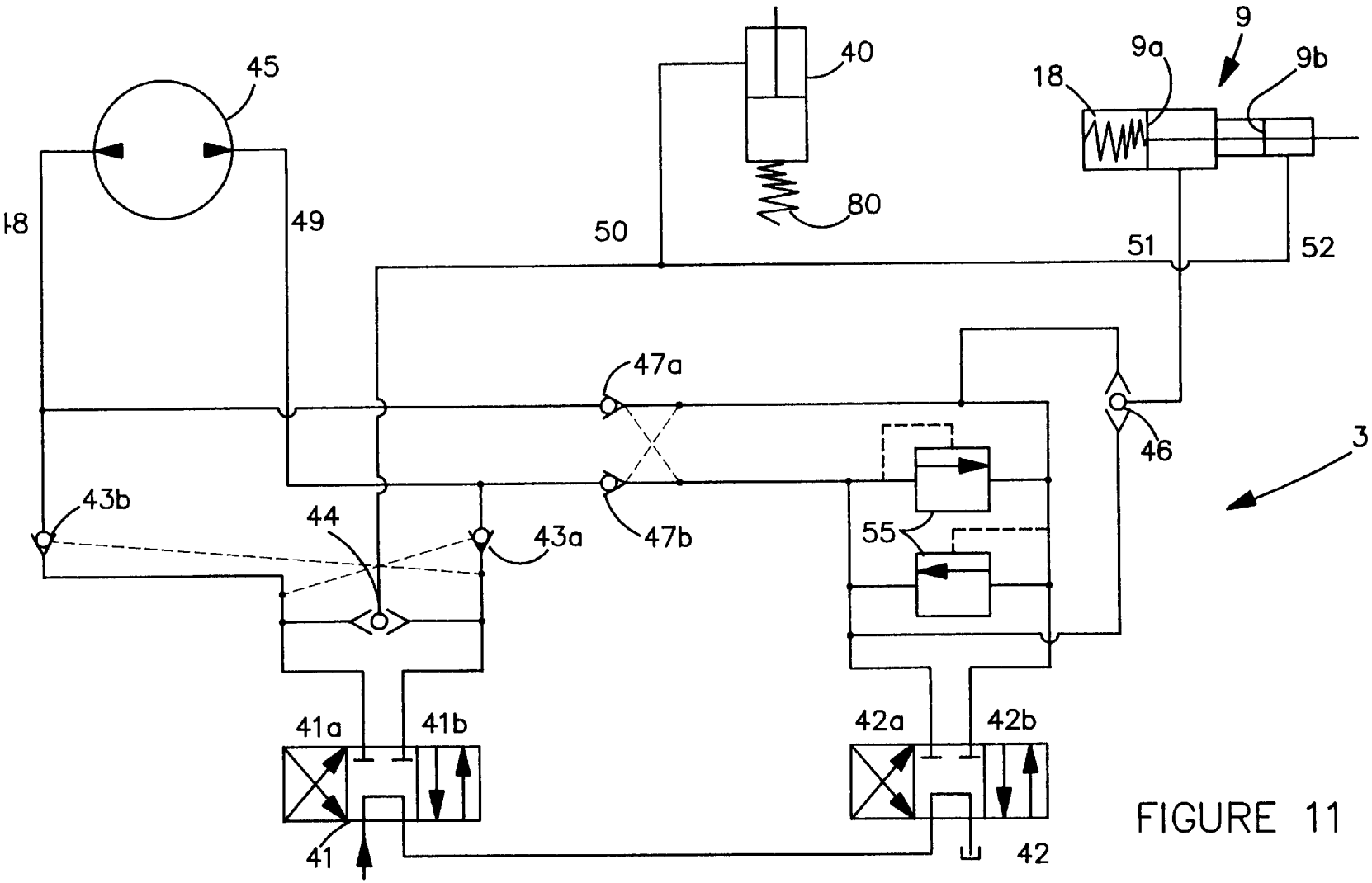
FIG. 11 is a schematic view of a fluid circuit used in conjunction with the present invention.

By employing braking apparatus 1, cage plate latch 40, and detent means 36 in a specific sequence of operation, the throat of a power tong can be automatically aligned with the openings in the ring gear 28 and the cage plates 29 and 30 without the operator needing to view the power tong throat. FIG. 11 represents schematically one embodiment of a fluid circuit which would control the interaction of cage plate latch 40, braking apparatus 1, and detent means 36. Control circuit 3 will have a high pressure source 41 and a low pressure source 42 of hydraulic fluid. High the pressure source 41 will power hydraulic motor 45 when the power tongs are closing on and applying the high torque needed to make-up or break apart a tubular member joint. Low pressure source 42 will also supply fluid to motor 45 but for the purpose of releasing the tubular member and realigning the power tong throat with the openings on the ring gear 28 and cage plates 29 and 30. Motor 45 will have two lines 48 and 49 which will cause the motor 45 to supply torque in the clockwise or counter-clockwise direction, depending on through which line fluid is supplied. When fluid is being supplied by one line, for example line 48, then the other line (49) will act as a return line allowing the fluid to complete a circuit back to source 41. Fluid pressure source 41 will have lines 41*a* and 41*b* for supplying fluid to lines 48 and 49 respectively. Fluid pressure source 42 will have lines 42*a* and 42*b* for supplying fluid to lines 49 and 48 respectively.

In operation, the power tong will be positioned such that the tubular member is in the throat of the power tong. To allow the jaws to grip the tubular member, it is necessary to rotate the ring gear 28 while holding the cage plates 29 and 30 stationary. To rotate the tubular member in a given direction (arbitrarily designated clock-wise), a valve will be opened at supply source 41 allowing high pressure fluid to flow through line 41*a*. Fluid will flow through pilot operated check valve 43*b* and line 48 to supply power to motor 45. Fluid will return byway of line 49 and 41*b*. Fluid is able to pass through pilot operated check valve 43*a* because a cross-over line (shown by dashed lines) will displace the ball of pilot operated check valve 43*a* and open valve 43*a* to returning fluid. As fluid is being supplied to motor 45, fluid will simultaneously flow through shuttle valve 44 towards cage plate latch 40 and small piston head 9*b* of dual piston cylinder 9 in gripping device 11. The latch spring 80 on cage plate latch 40 is sized such that it will be overcome by the fluid pressure and release cage plates 29 and 30 prior to small piston head 9*b* releasing braking surface 4 which is braking disc 5 in the embodiment shown in FIG. 4. As pressure increases, the torque applied by motor 45 to ring gear 28 increases. Because braking disc 5 is preventing rotation of cage plates 29 and 30, the torque applied to ring gear 28 is tending to cause relative rotation between cage plates 29 and 30 and ring gear 28 and tending to overcome detent means 36. As the torque threshold for overcoming detent means 36 is reached, ball 37 will be forced into bore 34 and ring gear 28 will begin to rotate relative to cage plates 29 and 30. However, cage plates 29 and 30 are still held stationary since small piston head 9*a* is sized to insure that the fluid pressure needed to produce the torque overcoming the release threshold of detent means 36 is less than the fluid pressure necessary to overcome spring 18 and release braking disc 5. After ring gear 28 has rotated sufficiently relative to cage plates 29 and 30 to close the tong jaws, further increases in torque will begin to increase the radial force the jaws are exerting on the tubular member. The rise in torque corresponds to an increase in fluid pressure which will at a predetermined point be sufficient to overcome spring 18 and cause brake caliper 7 to release brake disc 5. With the release of brake disc 5, there is no longer a frictional resistance caused by a braking apparatus 1 and all power may be applied as torque on the tubular member.

Various valves will prevent the flow of fluid through incorrect lines. When fluid is traveling through line 41*a*, shuttle valve 44 will prevent fluid from entering line 41*b* and disrupting the return flow from motor 45. Similarly, pilot operated check valves 47*a* and 47*b* will prevent high pressure fluid from entering the low pressure side of fluid circuit 3. Pilot operated check valves 47*a* and 47 *b* will also have cross-over lines (shown as dashed lines) allowing low pressure fluid to circulate through motor 45.

After the desired torque load has been applied to the tubular member, the valve supplying fluid from high pressure source 41 will be closed and the pressure in the system will be allowed to dissipate. The spring 80 in cage plate latch 40 will again move latch pin 82 into engagement with latch slot 83 and spring 18 will urge braking caliper 7 to grip braking disc 5. Since the openings of the cage plate and ring gear will be in whatever arbitrary position they were in when the tongs stopped rotating the tubular member, these members will not be aligned with the throat of the power tong. To effect this alignment so that the power tong may be backed off the tubular member, low pressure hydraulic fluid will be introduced into the hydraulic circuit from low pressure source 42. As the above example supplied high pressure fluid to line 48 in order to apply torque to the tubular member, fluid must be supplied to line 49 in order to reverse the direction of the power tong's rotation. Therefore fluid flows from line 42*a* through pilot operated check valve 47*b* to line 49. Shuttle valve 46 allows fluid to enter line 51 but prevents fluid from interfering with the return flow from line 48. Pilot operated check valve 43*a* will prevent the fluid from entering the high pressure side of the circuit. Pilot operated check valve 47*a* will allow the return flow of fluid from motor 45 since cross-over lines have displaced the ball in pilot operated check valve 47*a*. It can be seen that fluid from low pressure supply 42 does not flow into line 50 to release cage plate latch 40, but fluid does flow to line 51 and large piston head 9*a*. The fluid supplied to motor 45 will cause motor 45 to begin rotating ring gear 28. However, the pressure does not produce sufficient force on piston head 9*b* to overcome spring 18 and release brake disc 5. Therefore cage plates 29 and 30 will be held in place and ring gear 28 continues to rotate until seat 38 of detent means 36 is aligned with bore 34 containing ball 37. Ball 37 will then be forced into seat 38 by spring 39 and ring gear 28 will be coupled with cage plates 29 and 30. At this point, the openings of cage plates 29 and 30 and ring gear 28 will be aligned. Because of the resistance imparted by the braking apparatus 1 to ring gear 28 through cage plates 29 and 30, torque resisting motor 45 will increase in conjunction with an increase in pressure in the hydraulic line. If braking apparatus 1 did not release cage plates 29 and 30, the increasing torque would eventually overcome detent means 36. However, piston head 9*a* is sized such that the pressure will overcome spring 18 prior to motor 45 generating sufficient torque to overcome detent means 36. Once piston head 9*b* overcomes spring 18 and braking apparatus 1 releases cage plates 29 and 30, the cage plates 29 and 30 and ring gear 28 will begin to rotate together. As discussed, no pressure has been supplied to cage plate latch 40 and therefore latch pin 82 (seen in FIG. 4) is biased against cage plate 29 by latch spring 80. As cage plate 29 continues to rotate, cage plate latch pin 82 will come into alignment with latch slot 83 and engage latch slot 83, thereby aligning the openings of cage plates 29 and 30 and ring gear 28 with the throat of the power tongs. Once again, the resistance to rotation will cause motor 45 to place higher torque on ring gear 28 which would eventually overcome detent means 36. However, cross-over relief valves 55 of fluid circuit 3 will divert fluid to the opposing line of motor 45 before the pressure is sufficient to overcome detent means 36. Since the openings of cage plates 29 and 30 and ring gear 28 are aligned with the throat of the power tong, the power tong may be backed off the tubular member and engage the next tubular member in the making up or breaking apart process.

Figure 15:
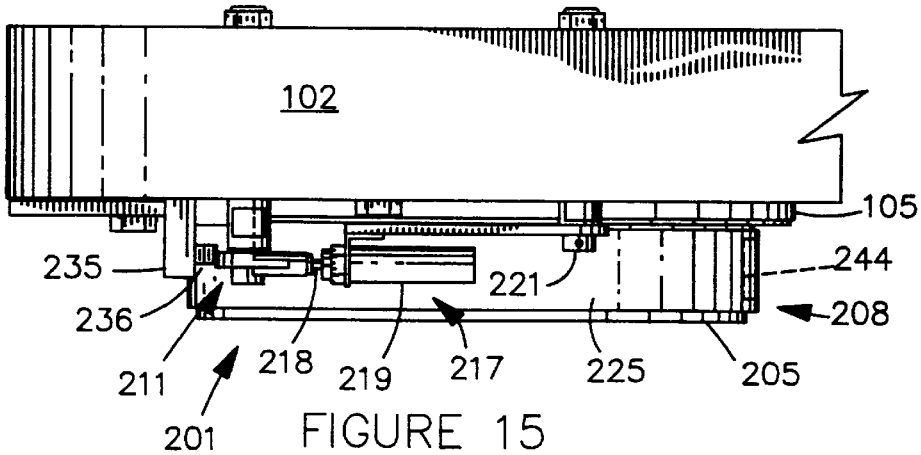
FIG. 15 is a side view of the embodiment illustrated in FIG. 14 as seen mounted under a convention power tong.
Figure 14:
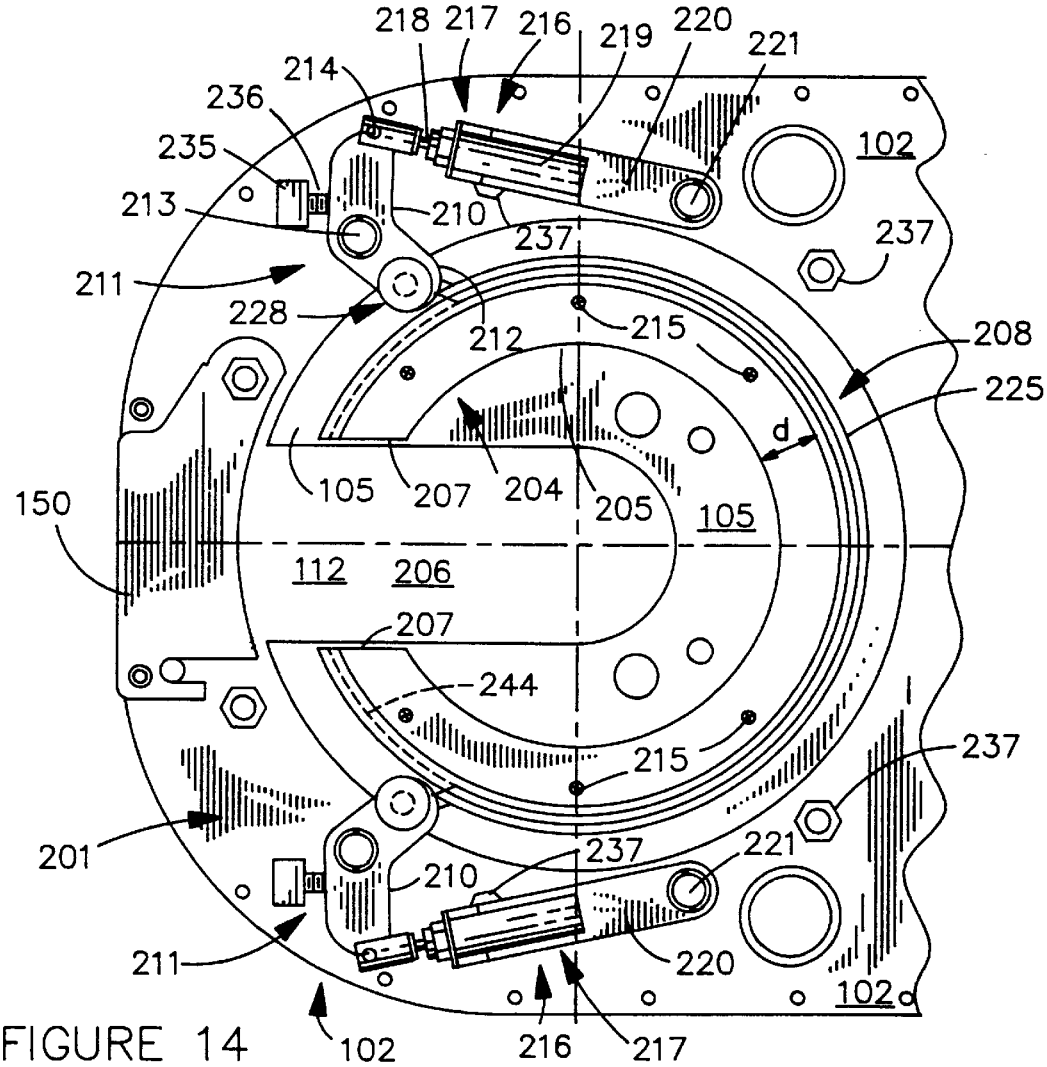
FIG. 14 is bottom planar view of another alternate embodiment of the present invention.

A still further embodiment of the present invention is seen in FIGS. 14–21. FIG. 14 illustrates a selectively releasable braking apparatus 201 which does not utilize the gear train arrangement discussed above. Similar to previous embodiments, braking apparatus 201 is operatively connected to a cage plate of a conventional power tong. FIG. 15 illustrates the front portion of power tong body 102 with the braking apparatus 201 connected to the lower cage plate 105. As seen in FIG. 14, the illustrated power tong body 102 has a tong gate 150 which may be opened to admit a tubular member into throat 112 of the power tong body 102. Braking apparatus 201 generally comprises a braking surface 204 such as brake ring 205, a brake gripping device 208 such as brake band 225, and a brake activating mechanism 211. FIG. 14 illustrates how brake ring 205 is fixedly connected to lower cage plate 105 by bolts 215 such that torque imparted on cage plate 105 is transferred to brake ring 205. Naturally, lower cage plate 105 may be fixed by other conventional means such as welding or by manufacturing a cage plate 105 which has a brake ring 205 formed integrally thereon. It can also be seen that the diameter "d" of brake ring 205 is relatively small as compared to that of lower cage plate 105. Furthermore, brake ring 205 includes an opening 206 between ring ends 207 which correspond to the open throat 112 of the power tong body 102 such that a tubular member may be positioned inside the power tong body 102 when tong gate 150 is opened. As best seen in FIG. 15, the perimeter of brake ring 205 will have a brake band retaining channel 244 formed therein. Brake band retaining channel 224 will have a rectangular shape in order to matingly engage wearing surface 227 of brake band 205.

Figure 18:
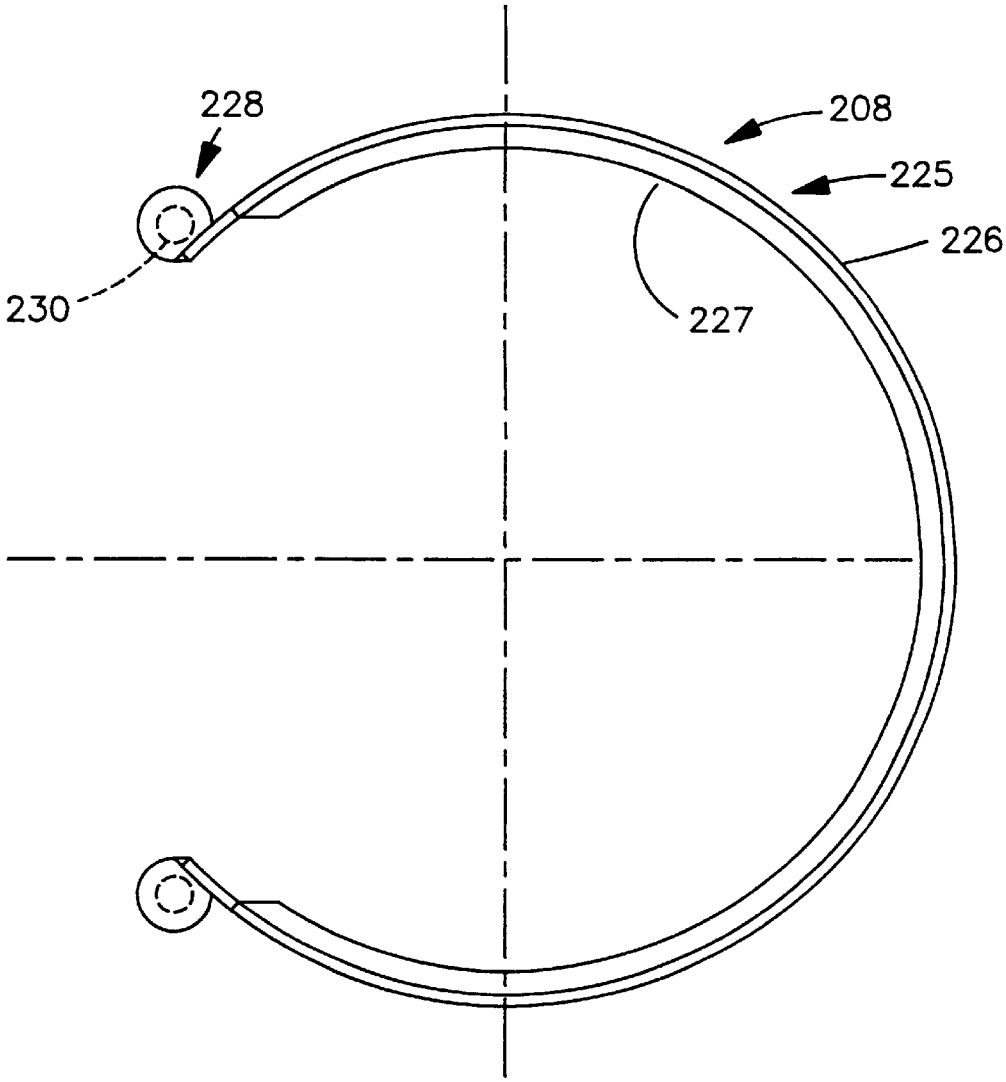
FIG. 18 is a top planar view of the brake band gripping device of the present invention.

Positioned along the outside perimeter of brake ring 205 is brake band 225. As best seen in FIG. 18, brake band 225 is a circular member with an outer band 226 and an inner wearing surface 227. Outer band 226 will comprise a flexible yet high tensile strength material such as steel. Wearing surface 227 will be formed on or securely attached to outer band 226 and will comprise a material having a high coefficient of friction such as a conventional asbestos substitute. One such material is known as "Brake Lining" and is supplied by Engineered Friction Products, 123 East Stiegel Street, Manheim, Pa. 17545. It will be understood that wearing surface 227 is intended to induce friction between it and brake ring 205 when brake band 225 is pulled against brake ring 205. This frictional contact is enhanced by wearing surface 227 being shaped to matingly engage channel 224 of brake band 225. It can also be seen from FIGS.

18 and 19 that each end of brake band 225 will have an eye-let structure 228. Eyelet structure 228 will provide the means by which brake activating mechanism 211 attaches to and causes brake band 225 to tighten against brake ring 205. As will be explained in greater detail below, a hook device on brake activating mechanism 211 will pass through eyelet aperture 231 and engage eyelet post 230. Of course, the scope of the present invention includes any manner of attaching wearing surface 227 to outer band 226 and any manner of attaching eyelet structure 228 to the ends of brake band 225.

Figure 16:
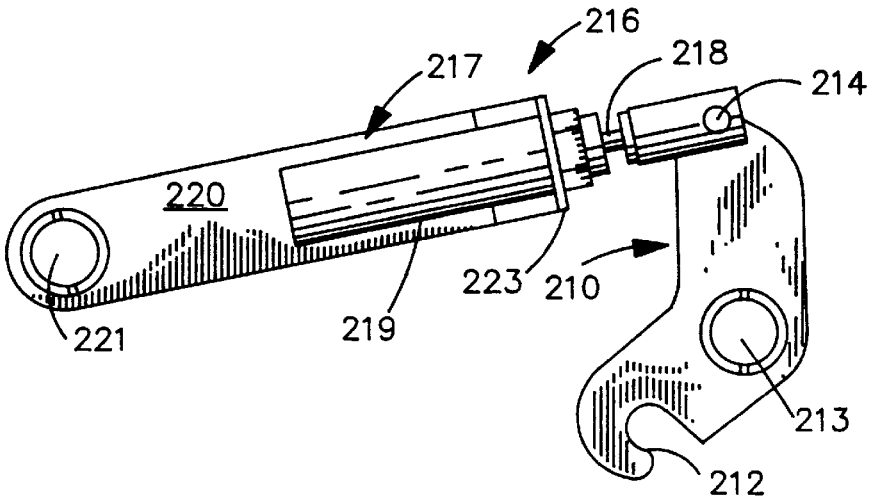
FIG. 16 is a top planar view of the brake activating mechanism of the present invention.
Figure 17:
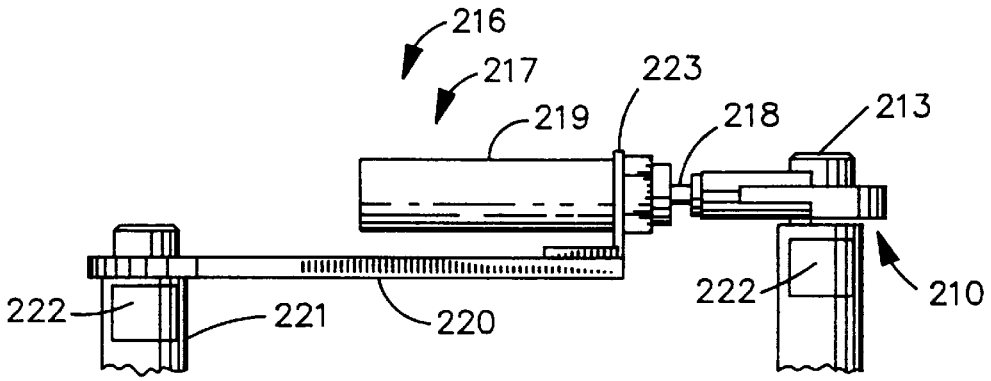
FIG. 17 is a side view of the brake activating mechanism illustrated in FIG. 16.
Figure 19:
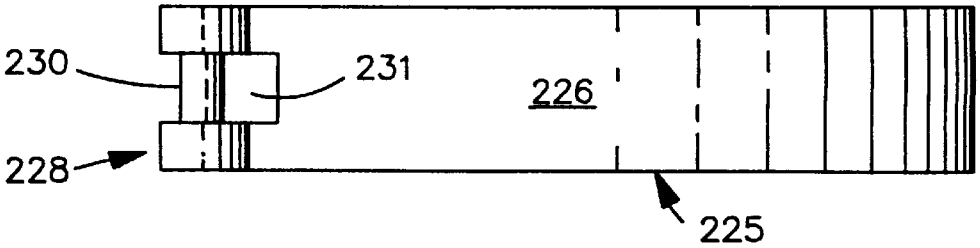
FIG. 19 is a side view of the brake band gripping device illustrated in FIG. 18.

Returning to FIG. 14, it can be seen how the structure of brake activating mechanism 211 is connected to brake band 225. In the embodiment shown in FIG. 14, brake activating mechanism 211 includes brake arm 210 and a linear actuator 216. As best seen in FIGS. 16 and 17, brake arm 210 is an angular shaped member with a hook section 212 formed on one end. Brake arm 210 also includes pivot pin 213 for pivotally connecting brake arm 210 to the power tong body 102 and a pin 214 for pivotally connecting brake arm 210 to linear actuator 216. In the embodiment shown, linear actuator 216 is a hydraulic piston and cylinder assembly 217 comprising cylinder body 219 and piston rod 218. Piston rod 218 is pivotally connected to brake arm 210 by pin 214 as described above. Additionally, cylinder body 219 is pivotally connected to the power tong body 102 by way of mounting arm 220. As best seen in FIG. 17, cylinder collar 223 fixes cylinder body 219 to mounting arm 220 which in turn is pivotally connected to the power tong body 102 by pivot pin 221. While FIG. 17 only shows the lower ends of pivot pins 213 and 221 by broken lines, it will be understood that these pins may be connected to the under side of the power tong body 102 in any conventional manner. For example, FIG. 14 shows a series of roller pins 237 such as are typically spaced around the perimeter of the cages plates and ring gear of a conventional power tong. The lower end of pivot pins 213 and 221 could be formed to the same dimensions as roller pins 237 and then be installed in the existing apertures designed for roller pins 237. In FIG. 14, both pivot pins 213 and 221 have been installed in apertures formed for roller pins 237. Pivot pins 213 and 221 will also have flat wrench faces 222 such that a wrench may be used to aid the installation of pivot pins 213 and 221 into the body 102 of the power tong. Of course, innumerable other methods of fixing pivot pins 213 and 221 to the power tong body 102 will be apparent to those skilled in the art and are included within the scope of the present invention.

The operation of braking apparatus 201 is best understood in viewing FIG. 14. As described above, the purpose of a conventional braking system on a power tong is to hold the cages plates stationary while the ring gear rotates a sufficient distance for the jaws to mount the cam surfaces and engage the tubular. When brake band 225 tightens against brake ring 205, friction between brake band 225 and brake ring 205 resists the rotation of brake ring 205 and thus lower cage plate 105 (which is also fixedly connected to the upper cage plate). The tightening of brake band 225 is carried out by the pivoting of brake arm 210 on pin 213. Hook section 212 engages eyelet aperture 231 (seen in FIG. 19) of the brake band eyelet structure 228. The opposite end of brake arm 210 is pivotally pinned to piston rod 218 by pivot pin 214. Therefore when piston rod 218 moves rearward or is drawn into cylinder body 219, hook section 212 of brake arm 210 moves forward and places tension on brake band 225. It will be understood that both of the hydraulic piston and cylinder assemblies 217 seen in FIG. 14 will be connected to a hydraulic circuit such that both piston and cylinder assemblies 217 operate simultaneously. The tensioning of both ends of brake band 225 causes brake band 225 to be drawn tightly against brake ring 205 and greatly increases the frictional force resisting relative movement between brake band 225 and brake ring 205. It can also be seen from FIG. 14 that cylinder body 219 is pivotally mounted to tong body 102 by way of cylinder mounting arm 220 and pivot pin 221. By allowing cylinder body 215, to pivot, the present invention insures that a straight line is maintained between cylinder body 219 and the point at which pivot pin 214 of piston rod 218 connects to brake arm 210. Therefore, the proper alignment of pin 214 and cylinder body 219 is maintained even though the ends of brake arm 210 travel in an arcuate path as brake arm 210 rotates on pivot pin 213. When the fluid circuit of the present invention (described below) directs pressurized fluid into the cylinder bodies 219, piston rod 218 will be retracted into cylinder body 219 causing brake arm 210 to tighten brake band 225 against brake ring 205.

The piston and cylinder assembly 217 seen in FIG. 14 are designed to generate a pulling force at pin 214 which is sufficient to rotate hook section 212 of brake arm 210 forward and thereby tighten brake band 225 against brake ring 205. However, once the ring gear of the power tong begins rotating, placing torque to the cage plates and thus brake ring 205, brake ring 205's urge to rotate exerts a force in the opposite or rearward direction on one of the hook sections 212. Which hook section 212 will be subject to this force depends on whether brake ring 205 is urged to rotate clockwise or counter-clockwise. Typically the force created by the urging of brake ring 205 to rotate will be far greater than the piston and cylinder assemblies 217 seen in the figures could resist. To limit the distance which brake band 225 may move hook sections 212 rearward, the embodiment of FIG. 14 includes adjustment blocks 235 and set screws 236 positioned to the front of and adjacent to brake arm 210. Since set screws 236 will threadedly engage adjustment blocks 235, set screws 236 may be adjusted as desired in order to act as a stop in preventing the forward rotation of brake arm 210 when brake band 225 exerts a pulling force on hook section 212.

Figure 21:
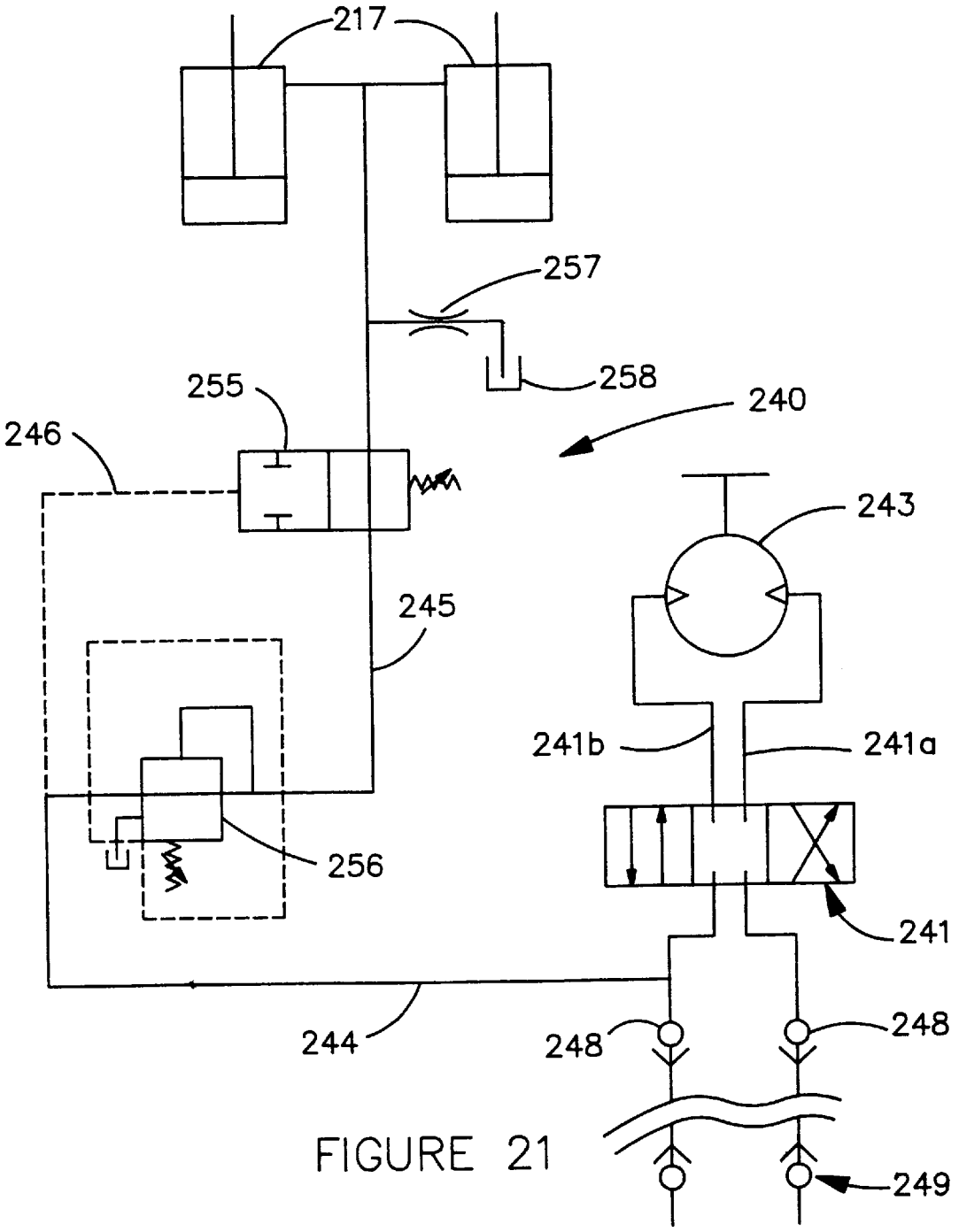
FIG. 21 is a schematic view of a fluid circuit controlling the embodiment of FIG. 14.

In order to control the activation of piston and cylinder assemblies 217, the disclosed embodiment of the present invention will employ the fluid control circuit 240 illustrated in FIG. 21. Fluid control circuit 240 will include conventional connectors 248 adapted for connection with an external fluid pressure source 249. Fluid circuit 240 will also include fluid directal control 241 which will direct pressurized fluid to either line 241*a* or 241*b*, depending on which direction it is desired for tong motor 243 to rotate. The fluid line 244 will carry the fluid needed to operate piston and cylinder assemblies 217. Because the pressure needed to operate piston and cylinder assemblies 217 is comparatively small to the pressure needed for the power tong motor 243 to generate the required torque loads, a conventional pressure reducing valve 256 will be positioned on the fluid line leading to piston and cylinder assemblies 217. In the embodiment shown, this pressure reducing valve will not allow the fluid pressure in the line 245, which feeds piston and cylinder assemblies 217, to exceed approximately 150 to 250 p.s.i. Positioned on line 245 downstream of pressure reducing valve 256 is a conventional cut-off valve 255. A control line 246 connects cut-off valve 255 with fluid from line 244 which is at the main pressure level received from fluid source 249. Therefore, when the main pressure in lines 244 and 246 reaches a predetermined level, cut-off valve 255 is activated and prevents any further increase in fluid pressure being transferred to piston and cylinder assemblies 217. In the embodiment show, fluid cut-off valve 255 will activate when the fluid pressure in line 246 reaches approximately 500 p.s.i. Fluid circuit 240 will also include a conventional bleed-off valve 257 which will allow the pressure in piston and cylinder assemblies 217 to dissipate once cut-off valve 255 has been activated. In the illustrated embodiment, bleed-off valve 257 is an orifice valve which allows fluid to dissipate to reservoir 258 when continuous pressure is not being supplied, but whose orifice is too small to seriously effect the pressure in piston and cylinder assemblies 217 when continuous fluid pressure is being supplied (i.e. before cut-off valve 255 is activated).

The operation of fluid circuit 240 allows brake band 225 to initially grip brake ring 205 in order to hold the cages plates stationary relative to the ring gear. In this manner, the jaws of the power tong may engage the tubular member positioned in the power tong's throat 112. Typically a pressure of approximately 500 p.s.i. is sufficient to have the power tong motor 243 impart enough torque to the ring gear such that the jaws will engage the tubular member. Thereafter, cut-off valve 255 will be activated cutting off the supply of pressurized fluid to piston and cylinder assemblies 217. Without a continuous supply of pressurized fluid, fluid pressure drops in piston and cylinder assemblies 217 as fluid bleeds off through valve 257 to reservoir 258. Piston and cylinder assemblies 217 therefore release the tension on brake band 225 and brake ring 205 is allowed to rotate with comparatively little friction from brake band 225. Thus, the full torque of the power tong motor 243 can be transferred to the tubular without significant losses from brake band friction as is the case with prior art power tongs.

Figure 20:
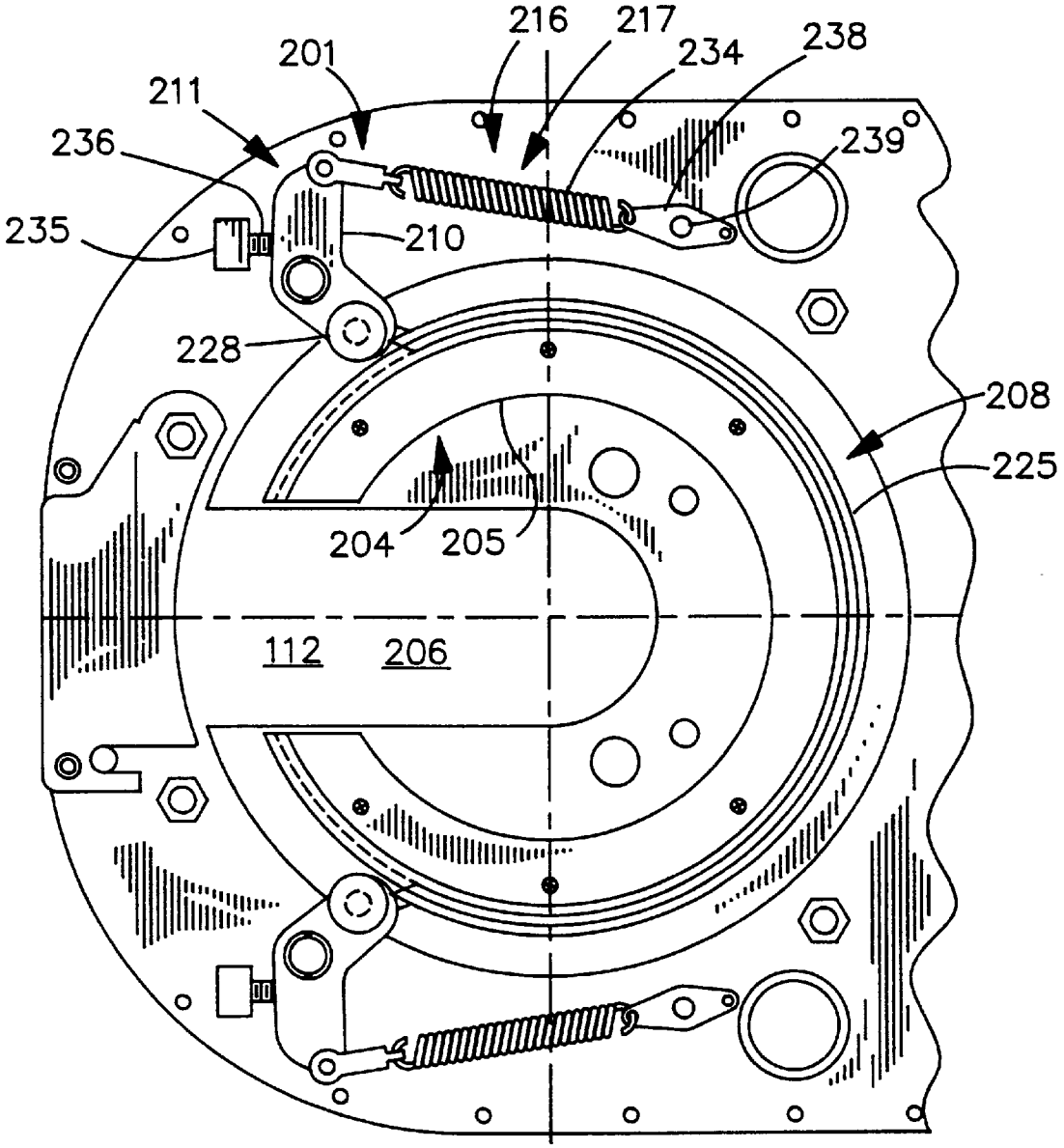
FIG. 20 is a top planar view illustrating an alternate brake activating mechanism.

An alternate embodiment of the invention of FIG. 14 is illustrated in FIG. 20. In FIG. 20, the linear actuator 216 comprises a biasing device such as spring 234. Spring 234 will be pivotally connected to brake arm 210 as in the previous embodiments. Spring 234 will also be pivotally connected to power tong body 102 by spring retainer 238 and pivot pin 239. Spring 234 will function in much the same way as piston and cylinder assembly 217 excepting that spring 234 is not capable of selectively releasing the tension holding brake band 225 against brake ring 205. Therefore the embodiment of FIG. 20 will constantly maintain frictional resistance between brake band 225 and brake ring 205 during the entire operating sequence of the power tong. Nevertheless, the embodiment of FIG. 20 still has a distinct advantage over prior art power tongs. In prior art power tongs, eventual reduction of the brake band wearing surface and stretching or elongation of the brake band through normal use will cause the brake band to not adequately grip the braking surface (typically the perimeter of the cage plate in prior art tongs). Therefore, there will be slippage between the cage plate and the brake band such that the tongs will not function reliably or may become completely inoperable. While a person skilled in the power tong art usually may adjust or tighten the brake band, such persons are not typically found in the oil field or on offshore platforms. Thus, the power tong must be shipped back to the power tong supplier or at least to a repair station. Such delays are very costly to the oil industry and are a significant disadvantage found in using prior art power tongs. Therefore the embodiment of FIG. 20 provides significant advantages over the prior art since it provides a method of maintaining the brake band 225 in a proper tension against brake ring 205. This tension is automatically adjusted to the proper level regardless of the natural elongation or deformation of brake band 225 which may occur over time from the strain on outer band 226 or from the wear-related reduction of the wearing surface 227. It will be understood that it is not only the spring activated braking mechanism of FIG. 20 which provides an automatically adjusting tension function, but also the piston and cylinder activated mechanism of FIG. 14. However, in addition to automatically adjusting the tension in brake band 225, the hydraulic piston and cylinder embodiment provides an mechanism for selectively releasing tension on the brake band 225 as described above.

Although the present invention has been described in terms of specific embodiments, it is anticipated that alterations and modifications thereof will no doubt become apparent to those skilled in the art. For example, it is envisioned that the function of the hydraulic circuit described above could be accomplished by other means. One such means could be an electro-mechanical means supplying a high source of power and a low source of power to the tong motor. Therefore the description of a high and low power source includes both electrical sources and fluid pressure sources. Similarly, the timed releasing of the cage plate latch and the braking apparatus could be carried out by solenoids or similar electro-mechanical devices. It is therefore intended that the following claims be interpreted as covering all such alterations and modifications which fall within the true spirit and scope of the invention.

I claim:

1. An automatically adjusting braking apparatus for a power tong comprising:

a) a brake ring connectable to a cage plate of a power tong and having an opening corresponding to the throat of a power tong;

b) a brake band positioned proximately to said brake ring such that said brake band is capable of contacting said brake ring;

c) a tensioning device for exerting a tension on said brake band; and d) a brake arm having:

i) a pivot pin for pivotally connecting said brake arm to a power tong body;

ii) a first section connected to said brake band; and iii) a second section connected to said tensioning device.

2. An apparatus according to claim 1, wherein said tensioning device exerts a constant tension as said brake band deforms.

3. An apparatus according to claim 1, wherein said tensioning device selectively exerts tension on said brake band.

4. An apparatus according to claim 2, wherein said tensioning device is a spring.

5. An apparatus according to claim 3, wherein said tensioning device is a hydraulic piston and cylinder assembly.

6. An apparatus according to claim 1, wherein said first end of said brake arm comprises a hooked end for engaging said braking band.

7. An apparatus according to claim 1, wherein an adjustment block attachable to a power tong prevents rotation of said brake arm beyond a preset limit in a given direction.

8. An apparatus according to claim 7, wherein said adjustment block includes a set screw and said given direction is a direction which removes tension from said brake ring.

9. An apparatus according to claim 6, wherein said brake band has an eye structure formed on each end for connection with said hooked end on said brake arm.

10. An apparatus according to claim 5, including a fluid circuit connectable to said hydraulic piston and cylinder assembly wherein said fluid circuit includes a pressure reducing valve limiting to a predetermined value the pressure of the fluid supplied to said piston and cylinder assembly.

11. An apparatus according to claim 10, wherein said fluid circuit includes a cut-off valve terminating fluid pressure to said piston and cylinder assembly after fluid pressure in said circuit reaches a predetermined limit.

12. An apparatus according to claim 11, wherein said fluid circuit includes a bleed-off valve relieving fluid pressure from said piston and cylinder assembly after said cut-off valve terminates fluid pressure to said piston and cylinder assembly.

13. An apparatus according to claim 1, wherein said first section of said brake arm is a first end and said second section of said brake arm is a second end.

14. An automatically adjusting braking apparatus for a power tong having a cage plate positioned within a tong body, both said cage plate and said body having a throat, said braking apparatus comprising;

a) a brake ring connected to said cage plate and having an opening corresponding to said throat of said power tong;

b) a brake band positioned proximate to said brake ring such that said brake band is capable of contacting said brake ring;

c) a tensioning device connect to said power tong body for exerting a tension on said brake band; and d) a brake arm pivotally connected to said power tong body, said brake arm having a first end connected to said brake band and a second end connected to said tensioning device.

15. An apparatus according to claim 14, wherein said tensioning device is a spring.

16. An apparatus according to claim 14, wherein said tensioning device is a hydraulic piston and cylinder assembly.

17. An apparatus according to claim 16, including a fluid circuit connectable to said hydraulic piston and cylinder assembly wherein said fluid circuit includes a pressure reducing valve limiting to a predetermined value the pressure of the fluid supplied to said piston and cylinder assembly.

18. An apparatus according to claim 17, wherein said fluid circuit includes a cut-off valve terminating fluid pressure to said piston and cylinder assembly after fluid pressure in said circuit reaches a predetermined limit.

19. An apparatus according to claim 18, wherein said fluid circuit includes a bleed-off valve relieving fluid pressure from said piston and cylinder assembly after said cut-off valve terminates fluid pressure to said piston and cylinder assembly.

* * * * *